United States Patent [19]

Kerr, Jr.

[11] 3,998,253

[45] Dec. 21, 1976

[54] LEAD-PENCIL SHARPENER

[76] Inventor: Richard A. Kerr, Jr., 1714 Heritage Ave., Placentia, Calif. 92670

[22] Filed: Aug. 20, 1975

[21] Appl. No.: 606,074

[52] U.S. Cl. ..... 144/28.1; 144/28.71

[51] Int. Cl.[2] ..... B43L 23/04

[58] Field of Search ..... 144/28.1, 28.5, 28.6, 144/28.7, 28.71, 28.72, 28.8, 28.9

[56] References Cited

UNITED STATES PATENTS

| | | | |
|---|---|---|---|
| 2,523,663 | 9/1950 | Milne | 144/28.71 |
| 3,556,182 | 1/1971 | Tanigaami | 144/28.5 |

*Primary Examiner*—Donald R. Schran
*Attorney, Agent, or Firm*—Harvey C. Nienow

[57] ABSTRACT

A lead-pencil sharpener having a generally horizontally disposed shaving mechanism and a housing thereabout formed with an opening through which a lead-pencil may be inserted into said mechanism. A ledge member formed integrally with such housing or attachable thereto in a generally horizontal position beneath and in close proximity to the opening in the housing to catch lead and wood shavings which fall from the opening in the housing.

3 Claims, 7 Drawing Figures

LEAD-PENCIL SHARPENER

This invention relates generally to lead-pencil sharpeners, and more particularly to such sharpeners which are able to catch substantially all of the lead and wood shavings.

In spite of the advent within the past several decades of various different kinds and types of writing instruments, the ordinary lead-pencil is still very much in use within the United States. Such pencils are usually formed of long, thin, cyclindrical pieces of writing lead encased within a wooden housing. They are particularly popular for use in offices, schools and homes.

Lead-pencils must be sharpened periodically in order to provide a usable point. As such, sharpeners have been provided, the most common type being the one which comprises a generally horizontally disposed shaving mechanism whereby the wood and lead are simultaneously shaved or cut to the proper point.

Such sharpeners cause lead and wood shavings to be dropped about the sharpener during use, in spite of attempts to provide a housing around such shaving mechanism to catch the various shavings. That is, such housings have been provided with one or more openings through which the lead-pencils are inserted into the shaving mechanism for sharpening purposes. It is through such openings that wood and lead shavings continue to be forced, and hence such shavings, under the force of gravity, fall to the floor or desk whereon the sharpener is mounted.

Accordingly, it is an object of the present invention to provide a lead-pencil sharpener which is capable of collecting all of the shavings, to prevent the same from falling away from the sharpener.

Another object of the present invention is to provide a lead-pencil sharpener as characterized above which has a ledge member mounted beneath the opening in the housing to receive all of the shavings which are forced from the hole in the housing.

An even further object of the present invention is to provide a lead-pencil sharpener as characterized above wherein the ledge member is generally dish-shaped and is removable with the housing for disposing of the shavings.

A still further object of the present invention is to provide a ledge member and attachment means therefor to be mounted on an existing lead-pencil sharpener beneath the opening in the housing for collecting or gathering the shavings.

An even further object of the present invention is to provide a ledge member as characterized above whose attachment means comprises an adaptor which can be bonded to the housing of an existing lead-pencil sharpener.

A still further object of the present invention is to provide a lead-pencil sharpener and ledge member as characterized above which is simple and inexpensive to manufacture and which is rugged and dependable in operation.

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

Like reference characters indicate corresponding parts throughout the several views of the drawings.

Figure 1:
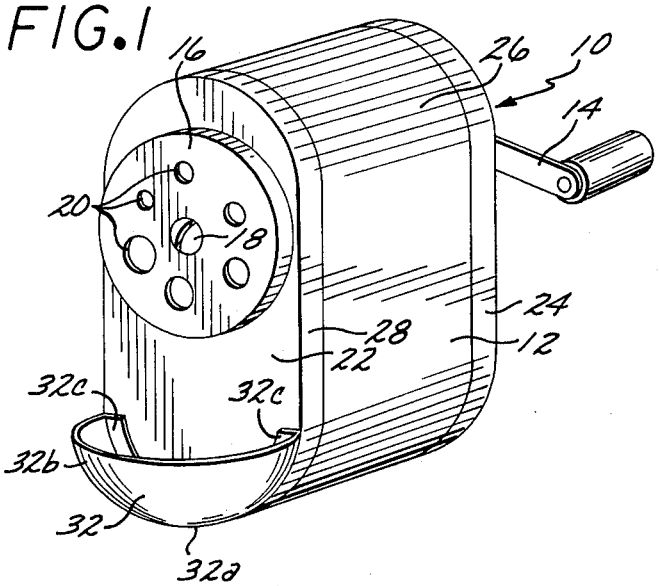
FIG. 1 is a perspective view of a lead-pencil sharpener according to the present invention.

Referring to FIG. 1 of the drawings, there is shown therein a lead-pencil sharpener 10 according to the present invention. Such sharpener 10 comprises a generally horizontally disposed shaving mechanism (not shown) within a housing 12. In addition thereto, such sharpener 10 comprises mounting means (not shown) usually in the form of a pedestal or bracket to which the shaving mechanism is operatively secured.

The shaving mechanism comprises motive power means such as handle 14 whereby the mechanism can be operated as desired. As will be well understood by those persons skilled in the art, the mechanism may be operated by other motive power means rather than a manual handle, such as an electric motor or the like.

The particular lead-pencil sharpener may be adapted for only a specific size or diameter of lead-pencil, or it may be provided with a selector element 16 as shown in FIG. 1. Such plate is rotatably mounted on housing 12, as by means of mounting screw 18, and is provided with a series of holes 20 of differing diameters to accomodate lead-pencils of different sizes as is well understood in the art.

The housing 12 is formed of plastic or relatively light sheet metal and is provided with a relatively flat forward wall 22, a correspondingly flat and relatively parallel rear wall 24, as well as a generally circular side wall 26. In addition to being decorative and affording a pleasing appearance to the sharpener, the housing 12 is intended for collecting and storing lead and wood shavings from the shaving mechanism within the housing. In spite of prior attempts to avoid the spilling of shavings from the housing 12, eventually such shavings are forced out of the housing through the opening (not shown) in front wall 22 which is provided for alignment with the selected one of the holes 20 in selector plate 16.

Figure 2:
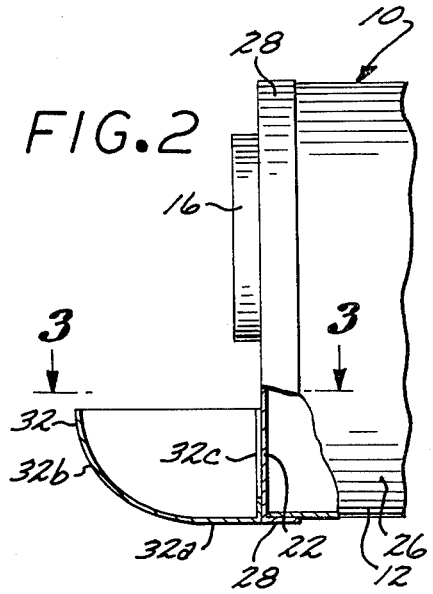
FIG. 2 is a fragmentary sectional view of the sharpener of FIG. 1.
Figure 3:
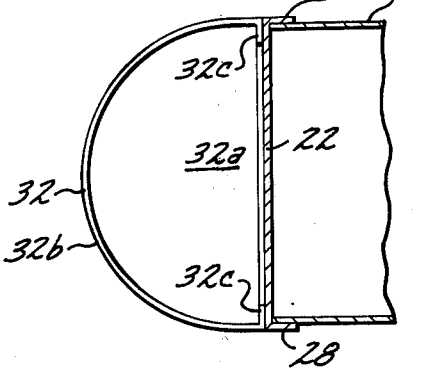
FIG. 3 is a fragmentary sectional view taken substantially along line 3—3 of FIG. 2.

As shown most particularly in FIGS. 1, 2 and 3 of the drawings, the front and rear walls 22 and 24 of the housing 12 are usually formed independently of the wrap-around side wall 26 and are attached thereto as by welding, bonding or the like. This is shown in FIGS. 2 and 3 wherein the front wall 22 extends over the side wall 26 as at 28.

To provide for the catching of the lead and wood shavings, a ledge member 32 is secured to the front wall 22, beneath and in close proximity to the hole in wall 22. Ledge member 32 may be dish-shaped as shown in FIGS. 1, 2 and 3 by having a generally horizontal bottom wall 32*a* and generally vertical side wall 32*b*. The rear wall of ledge member 32, as shown most particularly in FIG. 1, is formed with a mounting tab 32*c* which is bonded or welded to the face or front of wall 22 of housing 12.

As will be well understood by those persons skilled in the art, the ledge member 32 may be formed during the forming operation of the front wall 22 as a unit.

Thus, as the sharpener 10 is used, and lead and wood shavings accumulate within the housing 12 and within ledge member 32, at appropriate intervals, the housing may be removed from the shaving mechanism and all of the shavings within housing 12 and within ledge member 32 disposed of.

Figure 4:
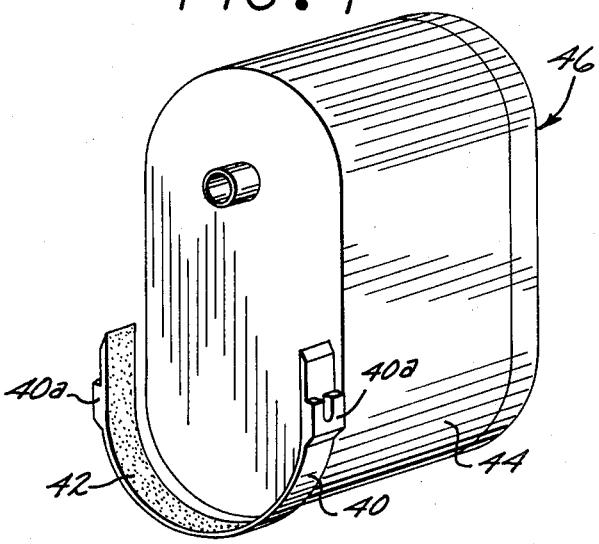
FIG. 4 is an exploded perspective view of a lead-pencil sharpener being provided with an adaptor.

The embodiment of the invention shown in FIG. 4, comprises a generally flexible adaptor 40 which is secured to the underportion of the forward wall 22 of housing 12 in any appropriate manner as by bonding or the like. It is contemplated that the adaptor 40 together with a separate ledge member to be hereinafter described, may be sold separately from the sharpener. A protective strip to be removed from the plastic adaptor 40 to fasten the same to a sharpener may be used to protect the bonding material 42 prior to such use.

Figure 5:
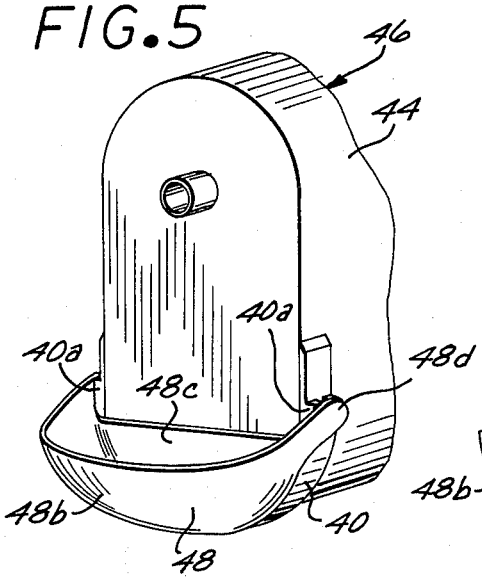
FIG. 5 is a fragmentary perspective view of a second embodiment of the present invention.
Figure 6:
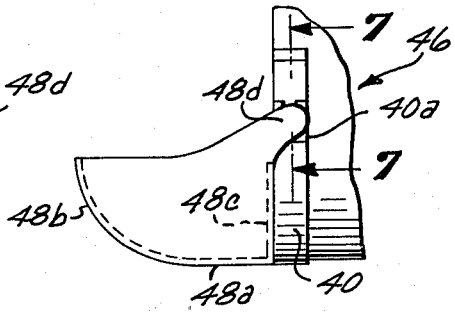
FIG. 6 is a fragmentary elevational view of the second embodiment of FIG. 5.
Figure 7:
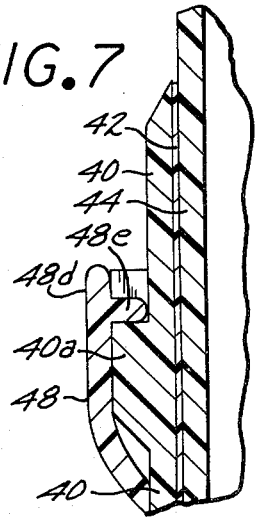
FIG. 7 is a fragmentary sectional view taken substantially along line 7—7 of FIG. 6.

The adaptor is mounted on the housing 44 of sharpener 46 as shown most clearly in FIGS. 5 and 6 of the drawings. Such adaptor 40 comprises retaining means in the form of a pair of oppositely disposed U-shaped elements 40*a*.

A ledge member 48 is formed of plastic and has a generally horizontal bottom wall 48*a* and a generally vertical side wall 48*b*, on the order of the aforedescribed ledge member 32. Ledge member 48 also comprises a rear wall 48*c* and a pair of oppositely disposed ears or tabs 48*d*. Each such tab is provided with an off-set element as shown at 48*e* for engagement with the generally U-shaped element 40*a*. Thus, the ledge member 48 can be mounted on the sharpener 46 merely by inserting the off-set elements 48*e* in the respective U-shaped elements 40*a* and permitting the ledge member 48 to be suspended therefrom. Continued use of lead-pencil sharpener 46 will cause lead and wood shavings to accumulate within ledge member 48. When desired, the ledge member may be removed from adaptor 40 and the contents thereof disposed of, as desired. The ledge member can then be returned to its operating position as shown in FIGS. 5 and 6 of the drawings. It is contemplated that the embodiment shown in FIGS. 4, 5, 6 and 7 may be formed of plastic material, and can be provided as an attachment for existing lead-pencil sharpeners.

It is thus seen that the present invention provides means for accumulating or collecting excess lead and wood shavings from a lead-pencil sharpener. Although I have shown and described certain specific embodiments of my invention, I am well aware that many modifications thereof are possible.

I claim:

1. For use with a lead-pencil sharpener having a horizontally operable shaving mechanism, a housing about said mechanism for collecting lead and wood shavings from said mechanism and formed with at least one opening through which a lead-pencil may be inserted, the combination of a generally cup-shaped ledge member formed with a generally horizontal bottom wall, generally vertical front and side walls and a mounting tab, said tab being attached to said housing to cause the latter to form a rear wall for said ledge member to thereby provide continuous vertical walls for retaining said shavings.

2. A lead-pencil sharpener comprising in combination, a horizontally disposed and operable shaving mechanism, a housing removably positioned about said mechanism for collecting lead and wood shavings from said mechanism and formed with at least one opening through which a lead-pencil may be inserted into said mechanism, means for operating said shaving mechanism, and a generally cup-shaped ledge member formed with a generally horizontal bottom wall, generally vertical front and side walls and a mounting tab, said tab being attached to said housing to cause the latter to form a rear wall for said ledge member to thereby provide continuous vertical walls for retaining said shavings.

3. A lead-pencil sharpener according to claim 2, wherein said ledge member is formed integrally with said housing.

* * * * *